United States Patent [19]

Peter et al.

[11] 4,402,153

[45] Sep. 6, 1983

[54] CARTRIDGE LOAD FOR A REVOLVER

[76] Inventors: Kurt Peter, Donaustrasse 101/12, A-2344 Maria Enzersdorf-Südstadt; Gerhard Muck, Peter Jordanstrasse 159, 1180 Wien, both of Austria

[21] Appl. No.: 251,730

[22] Filed: Apr. 7, 1981

[30] Foreign Application Priority Data

Apr. 16, 1980 [AT] Austria ..... 2052/80

[51] Int. Cl.[3] ..... F42B 39/04

[52] U.S. Cl. ..... 42/89

[58] Field of Search ..... 42/89

[56] References Cited

U.S. PATENT DOCUMENTS

| | | | |
|---|---|---|---|
| 913,393 | 2/1909 | Kellogg | 42/89 |
| 1,969,817 | 8/1934 | Milmore | 42/89 |
| 3,213,559 | 10/1965 | Matich | 42/89 |
| 4,254,571 | 3/1981 | Peter et al. | 42/89 |
| 4,325,198 | 4/1982 | Muck et al. | 42/89 |

FOREIGN PATENT DOCUMENTS

| | | | |
|---|---|---|---|
| 2259610 | 6/1974 | Fed. Rep. of Germany | 42/89 |
| 398690 | 9/1933 | United Kingdom | 42/89 |

*Primary Examiner*—Charles T. Jordan

*Attorney, Agent, or Firm*—Karl F. Ross; Herbert Dubno

[57] ABSTRACT

A loading device for the rounds or cartridges of a revolver comprises a generally circular array of pockets receiving the individual cartridges and a ring which can be grasped by a finger to draw the loading device away from the cartridges. The unitary device has a closed cartridge ring, which can be injection molded around the cartridges and has the finger ring disposed at one side, is provided with at least one weakened zone. The weakened zone enables the cartridge ring to readily spread open. The pockets for the cartridges preferably open inwardly toward the axis.

14 Claims, 7 Drawing Figures

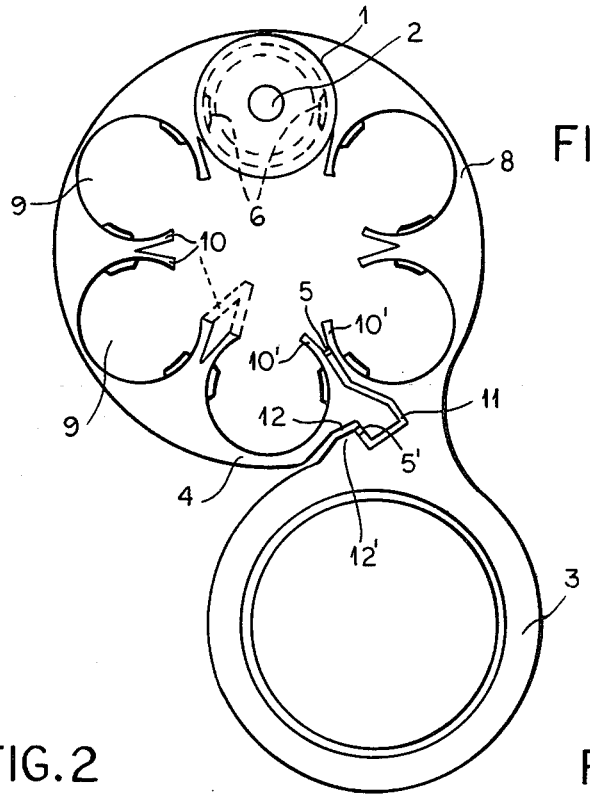
FIG.1
FIG.2
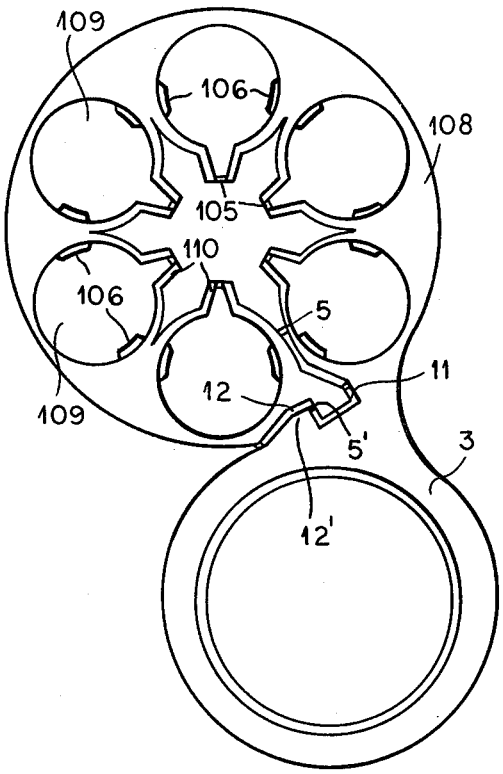
FIG.3
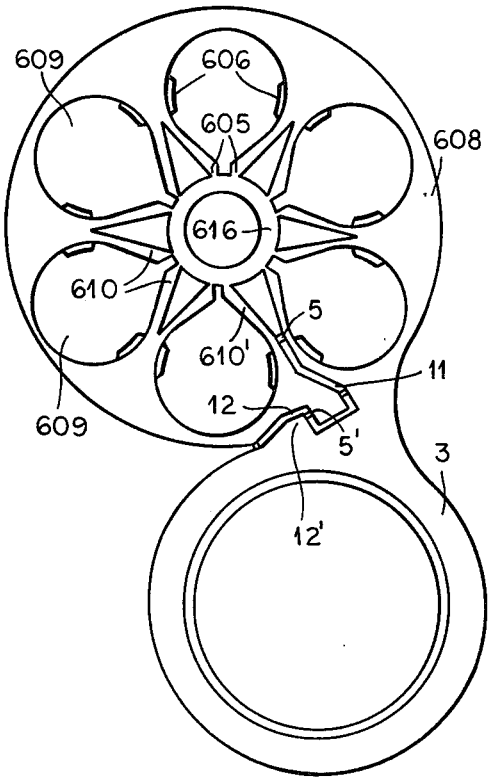

CARTRIDGE LOAD FOR A REVOLVER

CROSS REFERENCE TO RELATED PATENT

This application is an improvement upon the device described in our U.S. Pat. No. 4,254,571 issued Mar. 10, 1981 and entitled "Cartridge Load for a Revolver."

FIELD OF THE INVENTION

Our present invention relates to a cartridge load for a revolver and to a device facilitating the loading of a revolver by holding the cartridges thereof in a predetermined spaced apart relationship.

BACKGROUND OF THE INVENTION

It has been proposed to provide cartridge loads or packages for a revolver in which, in one case, a ring is formed with a plurality of pockets each of which is adapted to receive a cartridge casing so that the bullets of the respective rounds project in one direction and can be inserted into the chamber of the revolver drum.

This ring can be preloaded with the cartridges so that, upon the complete firing of the cartridges of the revolver, the spent cartridges can be removed as a unit and a fresh package of cartridges inserted as a unit. This affords rapid loading of the weapon in this case, the ring remains in place around the cartridges and generally speaking, the drum of this revolver or the ejector mechanism or other elements of the weapon must be accommodated to the use of this loading ring.

It has also been proposed (see U.S. Pat. No. 3,213,559) to provide the loading package so that the loading device can be stripped from the cartridges as soon as they have been partially inserted into the drum of the revolver.

In this unit, the loading device is constituted as a strip or belt having pockets corresponding in number to the rounds, which may be received in the cylinder of the revolver, with a spacing between them corresponding to the spacing between these rounds.

For introduction of the rounds into the revolver cylinder, the belt or strip can be rolled so that the bullet ends of the cartridges can be inserted into the respective bores of the cylinder and the strip or belt is then drawn away to release the cartridges in succession so that the latter can be pressed further into the respective bores.

When the belt is rolled up, the pocket-defining webs can bear one upon another to ensure the cylindrical pattern of the package which is retained by providing one end of the belt with a tab and the other end of the belt with a loop engageable by the tab to retain the package in place. Thus, when reloading of the revolver is necessary, the projecting portions of the cartridges of the package are inserted into the respective cylinder bores and the cylinder swung out of its normal position in the revolver, the tab is tugged to release it, and the belt is pulled away in the manner previously described, thereby inducing the cylinder to rotate as each pocket releases the respective cartridge. Each released cartridge can be pressed into place or can fall into place.

The strip or belt can be reloaded at a later time.

The pockets generally engage the body of the cartridge casing, which is cylindrical, between the flange or rim and the bullet over a length which is at least sufficient to ensure parallelity of the cartridges in the loading package.

Loading packages of this latter type have various disadvantages which have been discovered with experience utilizing them. For example, the hook-and-eye closure of the package may be released in normal handling operations, causing the package to open and constituting a manipulation problem.

Frequently the hook-and-eye closure jams so that the belt or strip cannot readily be drawn off the cartridges.

In order to ensure an effective anchoring of the cartridges, it has been found necessary with the belt-type device described above to form the ends of the webs or partitions between the pockets with beads or thickened portions. These have a tendency to lock between the cartridges and must be drawn out with considerable force. There is a tendency, therefore, for the partitions to tear or the pockets to deform and become unusable even after a few reloading cycles.

Of course, if the partition tears in use, at least one of the two cartridges held thereby must be removed by hand and the piece of the partition dislodged before the cylinder can be swung back into its firing position.

Thus, the advantages of high speed loading with packages of cartridges can be completely defeated and a danger created to an officer who must have his revolver in firing readiness in an emergency situation.

Other loading packages with similar disadvantages are described in British Pat. No. 398,690, Austrian Pat. No. 348,899, German Pat. No. 2,259,610, and U.S. Pat. Nos. 913,393; 1,969,817; and 1,971,526.

OBJECTS OF THE INVENTION

It is the principal object of the present invention to provide an improved cartridge package for a revolver which is free from the disadvantages enumerated above, i.e. enables the rapid loading of the revolver without the danger that the loading package will delay reloading in the event of an emergency situation.

Another object of the invention is to provide an improved loading device which facilitates the loading of the cylinder of a revolver.

SUMMARY OF THE INVENTION

These objects and others which will become apparent hereinafter are attained, in accordance with the present invention, by providing the one-piece device as a closed ring having a grip on one side thereof, the ring having at least one weakened portion constituting a preferred break region which retains the ring in its closed position when the package is intact, but upon a tug on the grip, ruptures to allow the grip to withdraw the loading device as a unit and release the cartridges.

In our U.S. Pat. No. 4,254,571, we have described a system which eliminates the disadvantages of the prior art devices as described and greatly facilitates the fabrication of a loading package and its use by injection molding the ring around the cartridges to produce the load package.

We have now found that it is possible to apply similar principles with a one-piece ring which, while not being molded around the cartridges, enables the cartridges to be inserted into the respective apertures and to be retained in these apertures or seats if the inner parameter of each seat or aperture is formed with at least one and preferably a plurality of inwardly projecting resilient protuberances engageable in the ejector-rim groove or the channel around the ejector rim of the cartridge base. Thus the one-piece rings of the present invention, otherwise formed in the manner described in the last-mentioned patent, can have resilient protuberances which spring into these grooves as the cartridges are thrust into the seats to retain the cartridges in a manner analogous to that used with the injection molding in our aforementioned patent.

According to a feature of the invention, each seat or aperture extends in the excess of 180° around the respective cartridge and at least two protuberances are provided on opposite sides of the seat.

The pockets of the ring, constituting cartridge sets, are preferably open inwardly toward the axis.

BRIEF DESCRIPTION OF THE DRAWING

The above and other objects, features and advantages of the present invention will become more readily apparent from the following description, references being made to the accompanying drawing, in which:

FIG. 1 is an elevational view of a cartridge package for a revolver in accordance with an embodiment of the invention, showing the ring receiving one of the cartridges; and FIGS. 2–7 are similar views of other embodiments of the loading device, illustrating units into which the cartridges can be inserted or which can be injection molded onto the cartridges.

SPECIFIC DESCRIPTION

Figure 4:
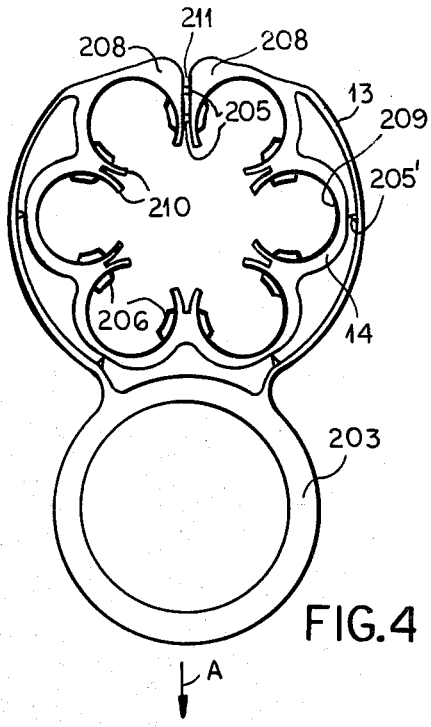

The cartridge package of the present invention can be used with a revolver whose cylinder or drum has a plurality of angularly equispaced bores each adapted to accommodate a respective cartridge and successively alignable with the barrel and hammer of the weapon. While the disks or rims of the present invention have six pockets or seats in which respective cartridges are received and hence the cartridge package is adapted for use with a six-shot revolver, the number of such seats can vary depending upon the number of bores in the revolver cylinder.

Generally the revolver cylinder can be swung out for loading and unloading.

In FIG. 1 a cartridge can be seen (from its bottom or rim 1) to have a primer or percussion cap 2 adapted to be struck by the revolver hammer.

The cartridges are held in the package by a synthetic resin (e.g. polyethylene) ring or disk which, upon engagement by the user, can be pulled away as is the case with the loading strip or belt previously mentioned. More particularly, the one-piece or unitary synthetic resin disk can be injection molded onto the cartridges and can be provided with weakened or breakaway points 5 which also serve to connect the arcuate members extending partly around each cartridge in an annular configuration. Another weakened zone in the form of a notch 12 is provided between a circular grip ring 3 and the other end of the synthetic resin element.

The grip 3 forms the transition between one of these arcuate members and a ligature 5 at the weakening notch 12.

It will be apparent from FIG. 1 that the synthetic resin ring formed by the interconnected and alternating arcuate elements 4 is circumferentially continuous until the loading operation is commenced.

In loading the weapon the package shown in FIG. 1 is inserted into the rear of an outwardly swung cylinder of the revolver so that at least the bullet ends of each of the cartridges is received in respective bore or cylinder, the insertion being perpendicular to the plane of the paper in FIG. 1.

The ring 3 is thereupon gripped and tugged away by the right hand while the weapon is held in the left hand, the grip being engaged between the thumb and ring finger. The weapon, which can also be a tilting-magazine revolver which can be broken open for reloading, is held with its barrel turned downwardly and the ring 3 is pulled away from the drum. The loading disk breaks first in the region of the notch 12, freeing the cartridge directly adjacent to grip ring 3 and allowing the arcuate portions 4 to be successively drawn away as the cylinder rotates thereby releasing the cartridges. The cartridges then can drop or be pressed home into the respective bores. The grip and attached portions of the loading disk can then be discarded and the cylinder swung back into place.

The loading disk of FIG. 1 thus consists of two circumferentially continuous but interconnected rings, the one being the gripping ring 3 while the other is a ring 8 formed with internally open seats or pockets 9 in which the cartridges are accommodated.

The ring 8 is formed with a split 11 which is bridged by one of the connecting webs 5 forming a weakened zone at which the ring 8 can be broken apart.

The separating walls between the seats or pockets 9 are formed at their inner extremities with inwardly diverging lugs 10' to resiliently hold the cartridges in the respective pockets. The two lugs of each separating wall can be passed to a collective width which does not exceed the smallest distance between neighboring cartridges. In FIG. 1 these ligatures are shown as they would lie in engagement with the cartridges. The lugs can be connected as shown at 10 in broken lines in this figure.

The split 11 is formed in the partition wall closest to the ring 3 and extends into the recess or groove forming notch 12 of the cartridge ring 8. A projection 12' from the gripping ring extends slightly into the recess 12 and a further weakened web 5' bridges the wall of the recess and the projection.

When a tug upon the grip ring 3 breaks first the web 5' and then the web 5 to enable the previously continuous cartridge ring 8 to distort into a belt configuration and be withdrawn from the cartridges, the lugs 10 upon withdrawal of the partition walls, are simply bent inwardly during this operation so that there is no danger of tearing. Since the pockets 9 are open inwardly and the cartridges are elastically held by the lugs 10, the cartridge package can be accommodated to various models of revolver as to different spacing of the cartidges.

The embodiment of FIG. 2 differs from that of FIG. 1 in that the ring 108 formed with the seats 109 for the individual cartridges has its lugs 110 inwardly convergent, rather than divergent and bridged by intentional-break webs 105 which, upon application of a tug to the ring 3 break apart as the cartridges are individually released.

In the embodiment of FIG. 3, however, the ring 608 has its seats 609 closed inwardly by a further ring 616 to which the lugs 610 and 610' reach and to which they are connected by intentional-break or weakened zones 605.

In the embodiments of FIGS. 1 through 3 as in the embodiments described subsequently, each seat 9, 109, 209, 309, 409 and 609 is provided with at least one pair of oppositely inwardly projecting molded protuberances 6, 106, 206, 306, 406, 606 which engage in the ejector groove at the base of the cartridge and grip the latter when a cartridge is inserted into the seat in a direction perpendicular to the plane of the disk. A similar function is provided by the protuberances 506 in the embodiment of FIG. 7.

In the embodiment of FIG. 3 one of the lugs, e.g. 610', adjacent the slit 11 can be fixed rigidly to the ring 3 and the inner ring 616.

FIGS. 4 through 7 show loading units of various configurations which have in common the fact that the gripping ring 203 may be drawn radially away from the package rather than tangentially as represented by the arrows A in these Figures. When the cartridges holder is turned away, therefore, no rotation of the cylinder is necessary or occurs.

In the double-wall embodiment of FIG. 4, the ring is connected by two relatively thin ligatures 13 to a pair of arcuate seat-forming members 208 which are interconnected by the weakened webs 205 at a gap 211, the remaining seats being represented at 209. All of the seats and pockets are spaced apart by partition walls which, as in the embodiment of FIGS. 1–3, have inwardly flaring resilient lugs 210 between adjoining seats or inwardly converging lugs for each seat. The inner walls 14 of the pockets 209 are connected to the ligatures 13 by intentional-rupture web 205'.

When the noses of the cartridges are inserted into the bores of the cylinder and the ring 203 is tugged, the webs 205, 205' rupture, members 208 are pulled apart at the gap 211 and the loading device is withdrawn from the array of cartridges.

Figure 5:
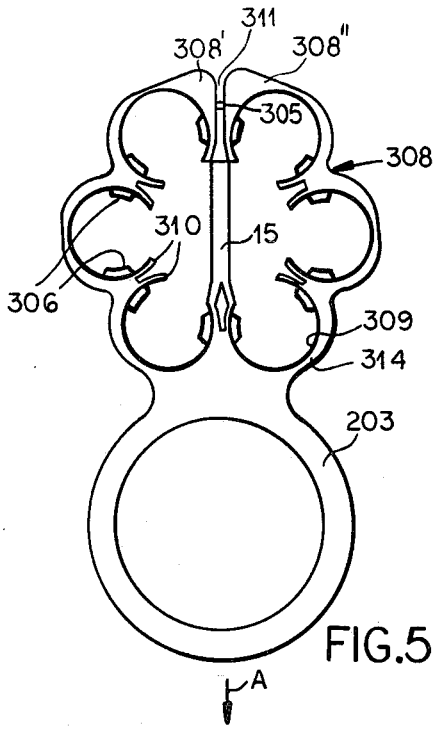
Figure 6:
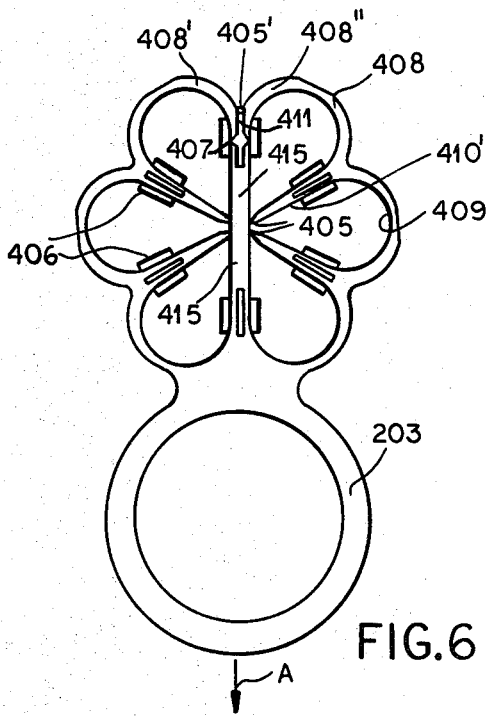

The embodiment of FIG. 5 functions in a similar fashion and has the ring 203 connected directly to the arcuate portions 314 forming the seats or pockets 309 with their flaring lugs 310 between them. Here, however, the two sections 308' and 308'' of the cartridge ring adjoin at the gap 311 at which they are interconnected by the intentional-rupture web 305. A tearing band 15 reaches from the ring 203 to the web 305 so that a tug upon the grip ring 203 pulls the strip 15 away and breaks the cartridge ring at the gap 311 so that the unit can be withdrawn from the array of cartridges. In the embodiment of FIG. 6 which is generally similar to that of FIG. 5 in that it has a tear strip 415 connected to the ring 203, the cartridge ring 408 is formed by the arcuate portions directly while the partition walls 410' between the seats or pockets 409 reach inwardly in a star configuration and are connected by intentional-break webs 405 with the strip 415. The strip 415, in turn, is connected to the remote arcuate members 408' and 408'' by weakening notches 407, these members being bridged, moreover, by an intentional-break web 405'.

When the ring 203 is withdrawn away from the array of cartridges and the latter are held in place by the cylinder of the revolver, the tear strip 415 breaks loose first, whereupon the gap 411 opens and the unit can be withdrawn.

Figure 7:
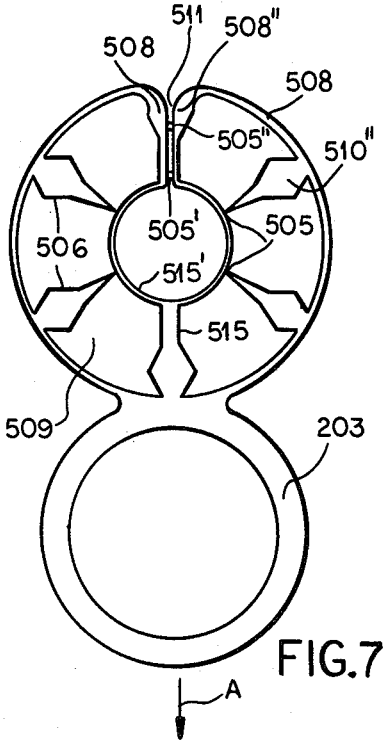

In the embodiment of FIG. 7, finally, the ring 203 is connected to a tension or tear strip 515 which forms one of the walls defining the pockets 509 receiving the individual cartridges. In this case, the other walls 510'' are connected at weak junctions 505 with an inner ring 515' split at the gap 511 and connected to the members 508' and 508'' defining this gap by an intentional-break web 505'. The gap 511 can be spanned by another such web 505''.

When the ring 203 is gripped and pulled away from the array for cartridges, the ring 515' first breaks loose and collapses inwardly, whereupon the gap 511 opens to release the cartridges.

Naturally, all of the loading devices shown can be injection molded directly around the cartridges or can be filled with the cartridges by axially inserting them into the respective pockets. The devices are effective for various weapon types, leave no pieces of material within the array of cartridges or on the cylinder, and provide packages of high stability before the units are torn apart. The units can also be pressed or bonded to the cartridges by the application of heat and pressure which can be effected during the swaging of the shell casing or other operations in the manufacture of the cartridge.

We claim:

1. A load package for a cylinder of a revolver, said cylinder having angularly equispaced bores adapted to receive respective cartridges, said package comprising:

an array of angularly spaced cartridge corresponding in number to said bores;

a circumferentially closed cartridge ring of synthetic resin material formed with a plurality of angularly equispaced seats each receiving one of said cartridges, said cartridge ring having at least one weakened point whereby an outward force applied to said ring will rupture said ring at said weakened point; and a grip ring unitary with said cartridge ring and adapted to be pulled to rupture said cartridge ring and enable said cartridge ring to be drawn away from said array of cartridges upon said cartridges being inserted in said bores, said cartridge ring being formed with an inwardly extending slit bridged by said weakened point, said grip ring being affixed to said cartridge ring on one side of said slit and having a projection extending into a recess formed on said cartridge ring on the opposite side of said slit.

2. The load package defined in claim 1 wherein each of said seats is formed with a pair of inwardly extending flexible lugs.

3. The load package defined in claim 2 wherein the ends of the lugs of each seat are interconnected at weakened webs.

4. The load package defined in claim 2, further comprising flexible members interconnecting the ends of the lugs of adjoining seats.

5. The load package defined in claim 2, further comprising an inner ring concentric with said cartridge ring, said lugs being connected to said inner ring at intentional-break locations.

6. The load package defined in claim 5 wherein one of said lugs adjacent said slit is rigidly secured to said inner ring.

7. The load package defined in claim 1, claim 2, claim 3, claim 4, claim 5 or claim 6 wherein each of said seats is formed with at least two respective projections engageable in a respective ejector groove of the respective cartridge for retaining the respective cartridge in said seat.

8. A load package for a cylinder of a revolver, said cylinder having angularly equispaced bores adapted to receive respective cartridges, said package comprising:

an array of angularly spaced cartridges corresponding in number to said bores;

a circumferentially closed cartridge ring formed with a plurality of angularly equispaced seats each receiving one of said cartridges, each of said seats being formed with at least two spaced-apart inward projections engageable in an ejection groove of a respective cartridge, and a pair of inwardly converging lugs, said cartridge ring being formed with a generally radial slit bridged by at least one intentional-break web and being composed of synthetic resin material; and a grip ring unitary with said cartridge ring and adapted, upon application of a tug to said grip ring, to open said cartridge ring at said slit and release said cartridges from said seats.

9. The load package defined in claim 8 wherein said lugs of each seat are bridged by intentional-break webs.

10. The load package defined in claim 8, further comprising flexible webs bridging the ends of the lugs of adjacent seats.

11. The load package defined in claim 8 wherein an inner ring is formed unitarily with said cartridge ring and inwardly thereof, said lugs terminating at said inner ring at intentional-break locations.

12. The load package defined in claim 8 wherein said grip ring is affixed to said cartridge ring opposite said slit.

13. The load package defined in claim 12 wherein said cartridge ring has a double-wall construction with an inner wall separated from the outer wall by a plurality of rupturable webs, said grip ring being connected to said outer wall.

14. The load package defined in claim 12, further comprising a tear band extending across said cartridge ring from said grip ring to said slit.

* * * * *